US006261080B1

(12) United States Patent
Schröter et al.

(10) Patent No.: US 6,261,080 B1
(45) Date of Patent: Jul. 17, 2001

(54) SPIN BEAM FOR SPINNING SYNTHETIC FILAMENT YARNS

(75) Inventors: Michael Schröter, Remscheid; Wolfgang Schümann, Wuppertal, both of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/331,394

(22) PCT Filed: Nov. 25, 1997

(86) PCT No.: PCT/EP97/06563

§ 371 Date: Jun. 18, 1999

§ 102(e) Date: Jun. 18, 1999

(87) PCT Pub. No.: WO98/27253

PCT Pub. Date: Jun. 25, 1998

(30) Foreign Application Priority Data

Dec. 18, 1996 (DE) ..... 196 52 755

(51) Int. Cl.[7] ..... D01D 4/06

(52) U.S. Cl. ..... 425/378.2; 425/382.2; 425/464

(58) Field of Search ..... 425/378.2, 382.2, 425/464, 192 S, 72.2, 7

(56) References Cited

U.S. PATENT DOCUMENTS

| | | | |
|---|---|---|---|
| 3,492,692 | | 2/1970 | Soda et al. . |
| 3,601,846 | * | 8/1971 | Hudnall ..... 425/131.5 |
| 3,824,050 | | 7/1974 | Balk . |
| 3,864,068 | | 2/1975 | Flakne . |
| 4,035,127 | | 7/1977 | Ogasawara et al. . |
| 5,354,529 | | 10/1994 | Berger et al. . |
| 5,637,331 | | 6/1997 | Lenk et al. . |
| 5,662,947 | | 9/1997 | Kretzschmar et al. . |
| 5,700,491 | | 12/1997 | Herwegh et al. . |
| 5,733,586 | | 3/1998 | Herwegh et al. . |

FOREIGN PATENT DOCUMENTS

| | | |
|---|---|---|
| 426763 | 9/1934 | (GB) . |
| 263535 | 11/1995 | (TW) . |
| 293041 | 12/1996 | (TW) . |
| 311945 | 8/1997 | (TW) . |
| WO 94/19516 | 9/1994 | (WO) . |

OTHER PUBLICATIONS

"SP50 Spin Beam" Barmag AG.
"Synthetic Fiber Production Technology" vol. 2, 2nd Ed., Nov. 1996, China Weaving Publishing Co., pp. 70–71.
"Polyester Fiber Handbook" 2nd Ed., Aug. 1995, pp. 172–174.

* cited by examiner

*Primary Examiner*—Nam Nguyen
*Assistant Examiner*—Joseph S. Del Sole
(74) *Attorney, Agent, or Firm*—Alston & Bird LLP

(57) ABSTRACT

A spin beam for spinning a plurality of synthetic filament yarns with a melt distributor block, which acommodates a spin pump and a plurality of spinnerets. In accordance with the invention, the melt distributor block consists of two structural members, which are interconnected in pressure-tight manner. In a separating line formed between the structural members, distributor lines are formed by grooves, which connect each a melt channel leading from the spin pump to a melt channel leading to the spinneret.

14 Claims, 5 Drawing Sheets

SPIN BEAM FOR SPINNING SYNTHETIC FILAMENT YARNS

BACKGROUND OF THE INVENTION

The invention relates to a spin beam for spinning a plurality of synthetic filament yarns and more particularly to an improved melt distribution system for such a spin beam.

A spin beam is known from U.S. Pat. No. 4,035,127, wherein a melt distributor block mounts in series a plurality of spinnerets. Each of the spinnerets is connected via a melt line to a spin pump, which is likewise mounted on the melt distributor block. The melt lines are formed substantially by bent pipes arranged in one plane. This arrangement involves the problem that the melt lines exhibit cross sectional variations due to the fact that the pipes are bent to a greater or lesser extent. However, for spinning a plurality of yarns it is necessary that each spinneret receive a quantitatively and qualitatively equivalent melt flow.

U.S. Pat. No. 5,354,529 discloses a spin beam, wherein each melt line between the spin pump and the spinnerets is formed by a bore in the melt distributor block. However, this layout involves the problem that the lengths of the melt lines between the spin pump and the spinnerets differ in a serial arrangement of a plurality of spinnerets. A further disadvantage of this layout is that sediments form in blind holes that are necessitated by manufacture.

It is therefore the object of the invention to further develop a spin beam of the initially described type in such a manner so as to permit even distribution of the melt from one spin pump to a plurality of spinnerets, so that each spinneret receives a qualitatively and quantitatively equivalent melt.

SUMMARY OF THE INVENTION

The above and other objects and advantages of the present invention are achieved by the provision of a spin beam which comprises a melt distributor block which has a plurality of melt distributor lines which extend respectively between one of the discharge outlets of the spin pump and an associated spinneret. The melt distributor block comprises two structural members which are interconnected in a pressure tight manner along a separating line, and each of the distributor lines includes a segment which extends along the separating line. In a preferred embodiment, these segments of the distribution lines are formed as a groove in one or both of the opposing surfaces defined by the structural members at the separating line.

With the above construction, it is accomplished that the respective deflections do not lead to cross sectional variations in the melt lines. Furthermore, the configuration facilitates construction of melt lines with very uniform cross sections. Consequently, each spinneret receives an equal melt flow. Furthermore, the arrangement of the melt lines in the distributor block has the advantage of achieving a high temperature stability in the melt due to the large mass of the block. The separating line between the structural members may be made horizontal or vertical.

When the grooves are arranged in the surface of the structural members, a hydraulically favorable transition is produced between the melt channels and the grooves. Of advantage is a construction, wherein the groove is exclusively formed in one of the structural members, in particular in the case of rectangular groove cross sections.

The segment of each distributor line which extends along the separating line may comprise a pipe which is positioned in a groove in one or both of the opposing surfaces. In this embodiment, the pipes are constructed only with thin walls, since they are supported by the structural members when pressure is applied. In the region of the pipes, it is not necessary to adapt the surfaces of the structural members for purposes of sealing a gap. The grooves can be realized in a simple manner as regards their manufacture, and they can be molded into the surface.

In another embodiment of the invention, a plate is positioned between the opposing surfaces along the separating line. This is advantageous when the opposing surfaces exhibit irregularities which can lead to leakage. To this end, the plate is constructed, preferably of a material, which is softer than the basic material of the structural members. In this connection, the grooves may be machined out of the surface of the plate in the form of flutes, or they may be provided in the plate as continuous grooves. In the case of continuous grooves, same are defined by the surfaces of the structural members. When providing flute-type grooves on the surface of the plate, bores are arranged, so as to interconnect the grooves between the structural members.

In a preferred embodiment of the spin beam, at least one of the opposing surfaces comprises two surface regions separated by a shoulder. Thus the contact surface area of the outermost surface region is reduced, so as to increase contact pressure. This allows to achieve a great sealing effect in the separating line.

The separating line may extend in a plane which is oblique to the horizontal. This prevents the melt flow from having to advance through 90° -deflections on its passage from the spin pump to the spinneret. Moreover, the melt line has a gradient between the spin pump and the spinneret. This will facilitate complete outflow of the melt without further auxiliary means from the spin beam, for example, when the spin line is shut down.

It has shown that preferably a gradient in the range of about 30° effects a satisfactory flow distribution.

The two structural members of the melt distributor block may be divided by a generally horizontal separating line to define an upper structural member and a lower structural member. In such embodiment, a favorable flow pattern is achieved by having the spin pump mounted to the upper structural member and the spinnerets mounted to the lower structural member. Also, the spin pump may be laterally offset relative to the spinnerets, which may be serially arranged on the spin beam, for example, side by side.

The melt supply line for the spin pump may include an inlet end in the upper structural member so that the melt supply line is located wholly within the upper structural member. This permits the overall height of the spin beam to be minimized.

Alternatively, the lower structural member may house the inlet end of the melt supply line so as to keep the spacing between the melt channels exiting from the pump as small as possible.

A very compact construction is realized in particular in that the spin pump is constructed as a gear-type distribution pump. In this construction, the contact surface of the pump on the upper part of the melt distributor block is a flat surface, which is in contact with the pump gears. As a result, a very stable plate-type construction is realized, so that due to a small thermal lag, very small clearances and, thus, very high sealing effects are obtained in the pump. However, it is also possible to mount the pump with an intermediate plate to the spin beam. This has the advantage that the pump may be handled as a complete unit.

The melt lines in the distributor block have a constant inside cross section over the length of the melt line. Thus, the melt flow is substantially identical in all melt lines. A favorable flow pattern results in particular when the inside cross sections of the melt lines are circular. However, it is likewise possible to realize without substantial expenditure cross sections in the form of an ellipsis, semicircle, rectangle, square, etc.

The lengths of the melt lines between the spin pump and the spinnerets are substantially the same, so that the dwelling time of the melt in the melt lines is substantially the same. The connection of the melt line to the spin pump as well as to the spinnerets is realized by the substantially vertically extending melt channels. This allows to ensure a flow-favorable outflow as well as a flow-favorable inflow.

BRIEF DESCRIPTION OF THE DRAWINGS

In the following, embodiments of the spin beam in accordance with the invention are described in more detail with reference to the attached drawings, as follows.

DETAILED DESCRIPTION OF THE PREFERRED EMBODIMENTS

Figure 1:
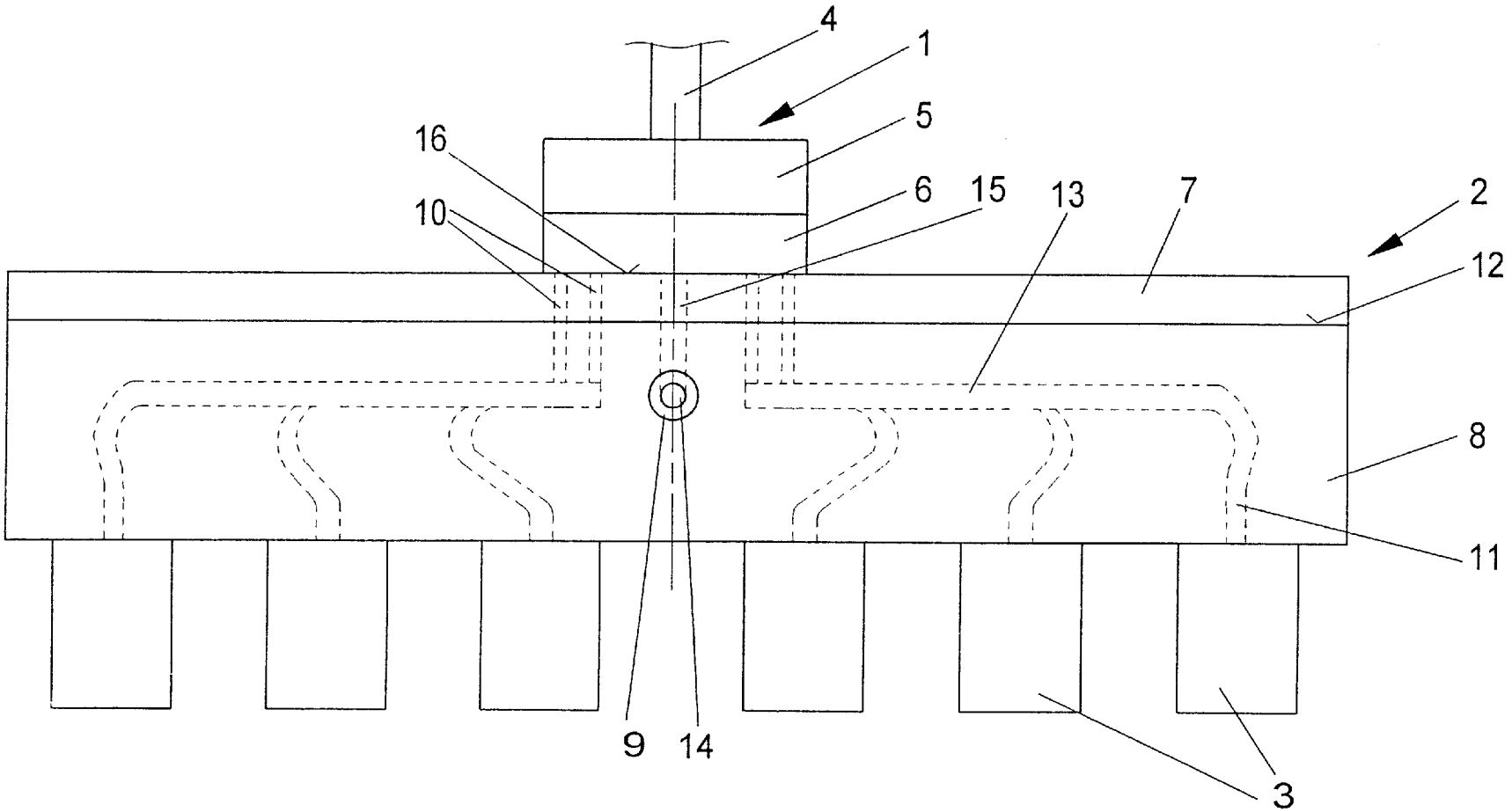
FIG. 1 is a schematic view of a first embodiment of a spin beam in accordance with the invention without a heating box.
Figure 2:
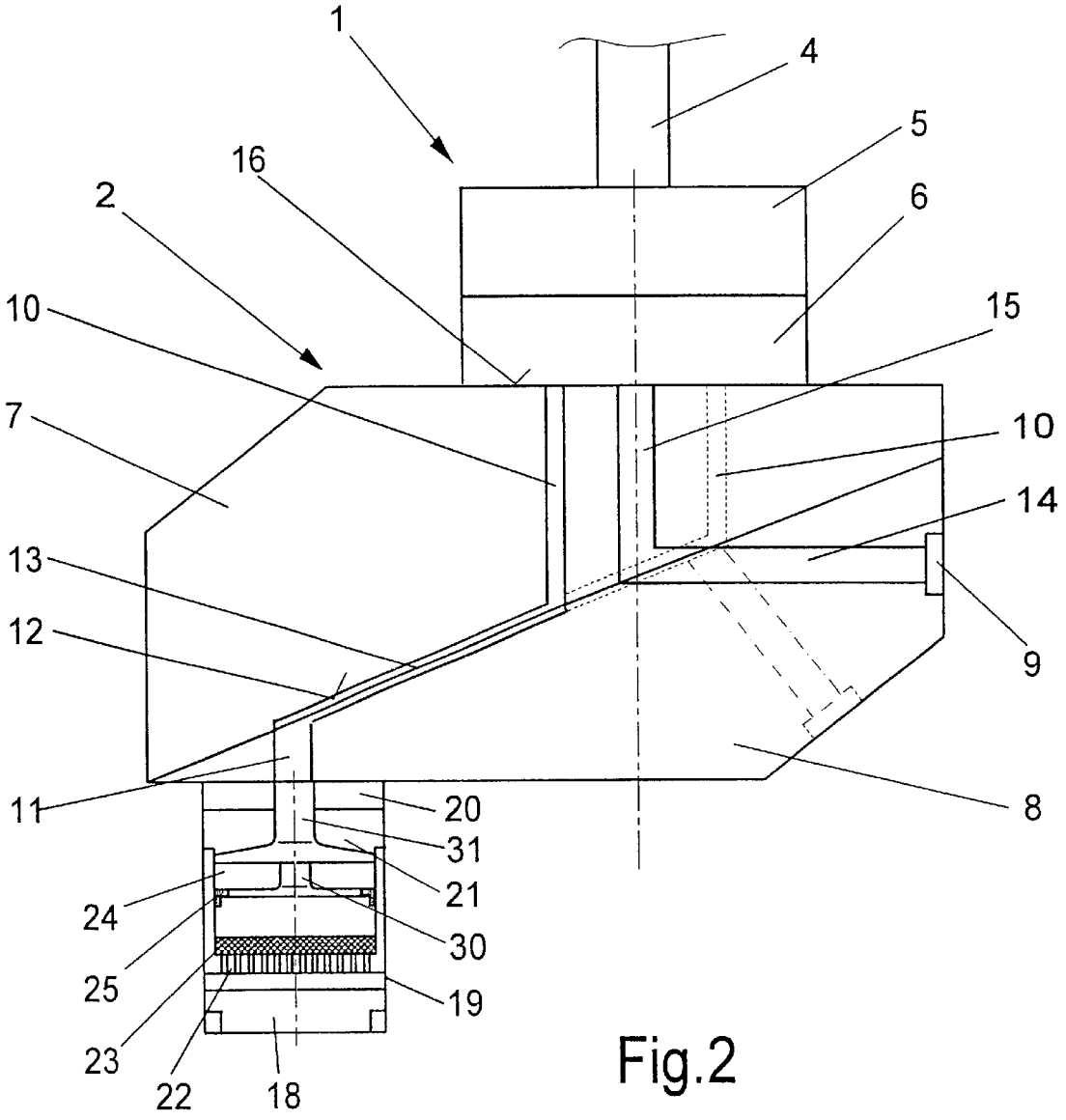
FIG. 2 is a schematic, cross sectional view of the spin beam of FIG. 1.

Schematically illustrated in FIGS. 1 and 2 is the layout of a first embodiment of a spin beam. The spin beam comprises a melt distributor block 2, a spin pump 1, and a plurality of—in the present illustration six—serially arranged spinnerets 3.

The melt distributor block 2 consists of two structural members, namely an upper part 7 and a lower part 8. The upper part 7 and the lower part 8 are interconnected in formfitting engagement. This formfitting engagement (not shown) is realized via a screw connection, wherein the screw forces are selected such that the melt being under pressure is unable to escape from a separating line 12. Mounted to the upper side of upper part 7 is spin pump 1. The spin pump 1 is connected via a drive shaft 4 to a drive. The spin pump 1 is constructed as a gear-type distributor pump, as is known, for example, from U.S. Pat. No. 5,637,331. In the arrangement shown in FIG. 1, a housing plate 6 of spin pump 1 is attached directly to the upper part 7 of the melt distributor block. The pump gears arranged in the interior of housing plate 6 thus lie against a flat surface 16, so that the pump gears are arranged between pump plate 5 and upper part 7. However, it is also possible to arrange an intermediate plate between upper part 7 and housing plate 6.

Provided in upper part 7 is a melt inlet end 9, which connects, via melt channels 14 and 15 (note FIG. 2) to the spin pump. From this inlet end, the melt which is supplied, for example, from an extruder, advances to spin pump 1. In the spin pump 1, the melt flow is divided into individual partial flows. The pump outlet ends are formed by melt channels 10, which are arranged as bores in the upper part 7 of the melt distributor block. The melt channels 10 terminate in the separating line 12, which is formed between the upper part 7 and the lower part 8. In the separating line 12, distributor lines 13 are provided in the surfaces of lower part 8 and upper part 7. Each of melt channels 10 ends respectively in one of these distributor lines 13. Altogether, six distributor lines 13 are thus arranged in the separating line 12. The distributor lines 13 are formed in separating line 12 in such a manner that they are each connected to one of melt channels 11. The melt channels 11 are provided as bores in the lower part 8, and they connect distributor lines 13 to one of spinnerets 3.

As shown in FIG. 2, the separating line 12 extends obliquely. Thus, each melt line formed by distributor lines 13 has a gradient. Furthermore, the junctions between melt channel 10 and distributor line 13 as well as between melt channel 11 and distributor lines 13 are realized at an angle greater than 90°.

In the present embodiment, distributor block 2 mounts side by side a total six spinnerets. The spinnerets 3 are identically constructed. To accommodate a spinneret, the lower part 8 has an attachment 20, which mounts a spin pack 19. The connection between attachment 20 and spin pack 19 can be realized, for example, by a screw thread, so that the spin pack 19 is screwed against lower part 8. Inserted into the bottom of spin pack 19 is a nozzle plate 18. Upstream of nozzle plate 18, the spin pack 19 accommodates a filter plate 22, which supports a filter 23. Between filter 23 and a connection piece 21, a displaceable sealing piston 24 and a gasket 25 are arranged. The sealing piston 24 is arranged for sliding movement with a clearance, and it has in its center a bore 30 which connects to melt channel 11. Also as shown in FIG. 2 by the dot-dashed lines, the vertical plane defined by the spinnerets is laterally offset from the vertical plane defined by the spin pump.

Each spinneret receives melt under pressure through melt channel 11. As a result, pressure builds up in spin pack 19. The gap between spin pack 19 and sealing piston 24 is sealed by gasket 25. To this end, the sealing piston 24 is pushed upward, so that connecting piece 21 contacts attachment 20 with a large surface, thereby ensuring a self-sealing action.

As shown in FIG. 2, the melt is supplied from, for example, an extruder through melt inlet end 9. The melt inlet end 9 is arranged in lower part 8 laterally offset by 90° with respect to the spin pump. A melt channel 14 terminates in melt inlet end 9. The melt channel 14 extends throughout lower part 8, so that it terminates in the separating line 12. At the same level, in separating line 12, upper part 7 accommodates melt channel 15. The melt channel 15 extends through upper part 7 and, thus, connects spin pump 1 to melt channel 14 in the lower part 8. Thus, the melt is supplied through the separating line 12. As a result, the spacing of the melt channels 10 extending in a divided circle is independent of the melt supply, so that a very compact construction of the distributor block is realized. To avoid a 90°-deflection in the supply flow, it would also be possible to locate inlet end 9 and melt channel 1 in the position shown in phantom lines in FIG. 2. The rectangular deflection of the melt, as is shown FIG. 2, could also be corrected by bores that are arranged in the structural members perpendicularly to the separating line. These bores coincide in melt channels 14 and 15.

Figure 3:
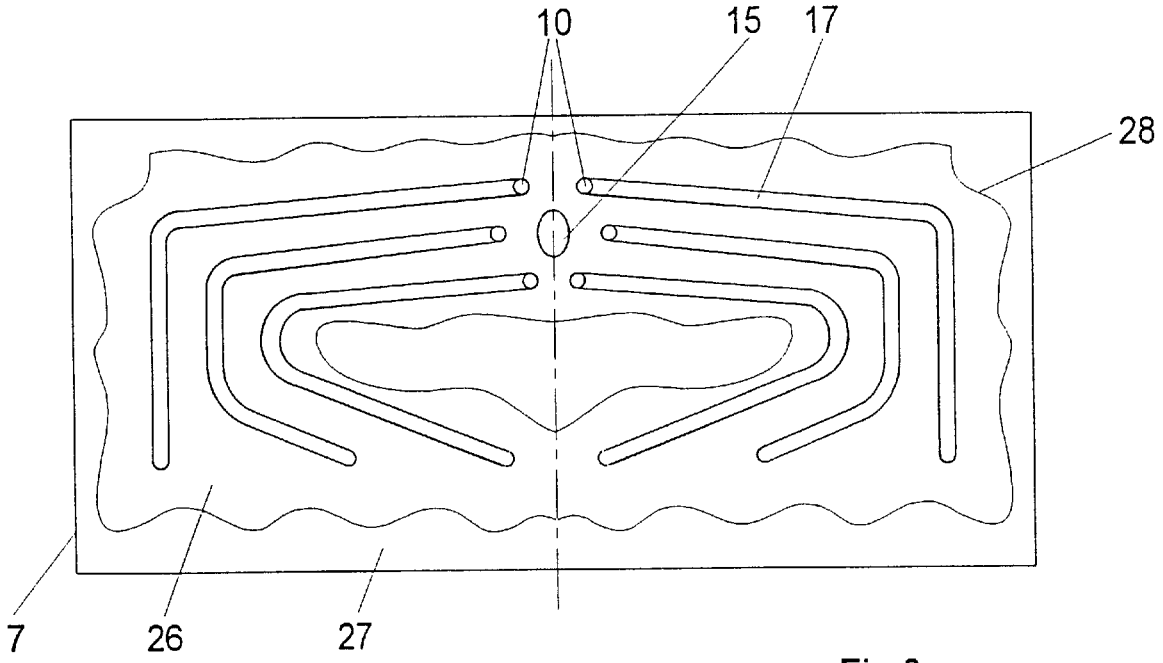
FIG. 3 is a top view of an upper part of a melt distributor block.

FIG. 3 is a top view of the separating surface of upper part 7. A separating surface 26 which is elevated relative to a surface 27 of upper part 7, is provided with a plurality of grooves 17. A shoulder 28 is thus defined between the surfaces 26 and 27. The grooves 17 start each from an outlet of one of melt channels 10. The melt channels 10 form the connection to the outlet ends of spin pump 1. The grooves 17 are arranged in separating surface 26, so that their ends are in exact alignment with the openings of melt channels 11, when combining the upper and the lower part. In this arrangement, the lengths of grooves 17 respectively between one melt channel 10 and one melt channel 11 could be made identical. The grooves 17 may be arranged in separating surface 26 by machining or by molding. To realize a hydraulically favorable cross section, the grooves are made with a semicircular cross section. However, any other cross sectional shapes may be realized.

Figure 4:
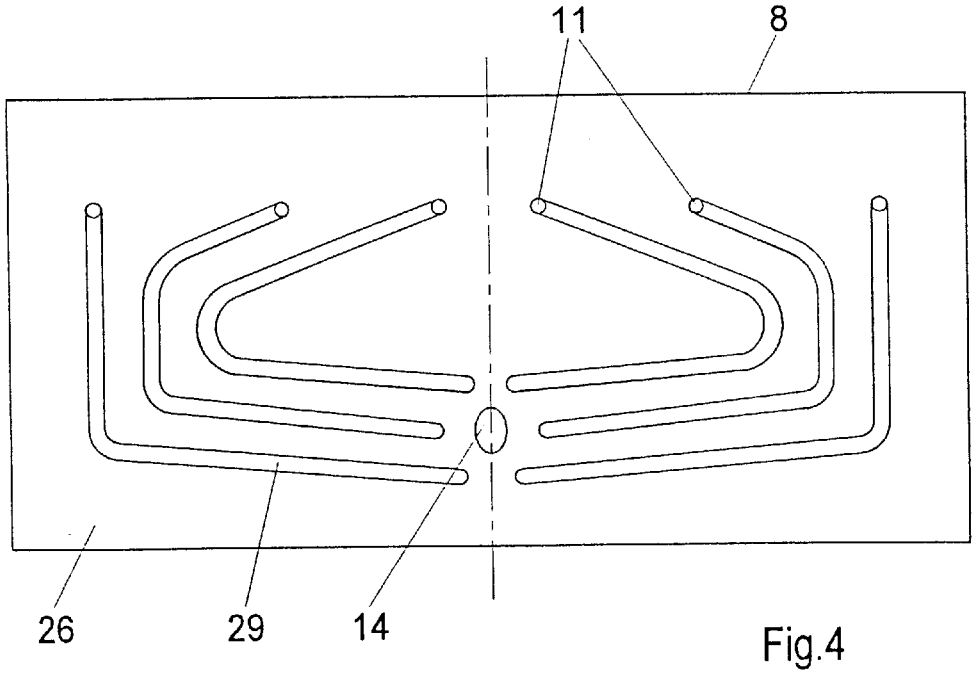
FIG. 4 is a top view of a lower part of a melt distributor block.

FIG. 4 is a top view of lower part 8 along separating line 12. Its surface 26 contains likewise a total of six grooves 29. The arrangement of grooves 29 in surface 26 is identical with the arrangement of grooves 17 in the separating surface 26 of upper part 7. Thus, when joining upper part 7 and lower part 8, the distributor lines 13 are formed by grooves 17 and 29. The connection of the lower part to the upper part is realized such that a metallic seal in the separating line prevents the melt from leaking out of the distibutor lines into the separating line.

As shown in FIG. 4, the outlet end of melt channel 14 is located at the level of melt outlet 15 in FIG. 3. As a result, the connection between the two melt channels 14 and 15 is realized likewise by joining the upper and the lower part. The seal in the separating line is likewise metallic. However, it is also possible to arrange special seals between the lower and the upper part.

The surface configuration shown in FIG. 3 could also apply to the lower part, as can be realized by the configuration of the surface of FIG. 4 for the lower part.

The upper part 7 and lower part 8 can be joined to a distributor block, for example, by screw connections.

Figure 5:
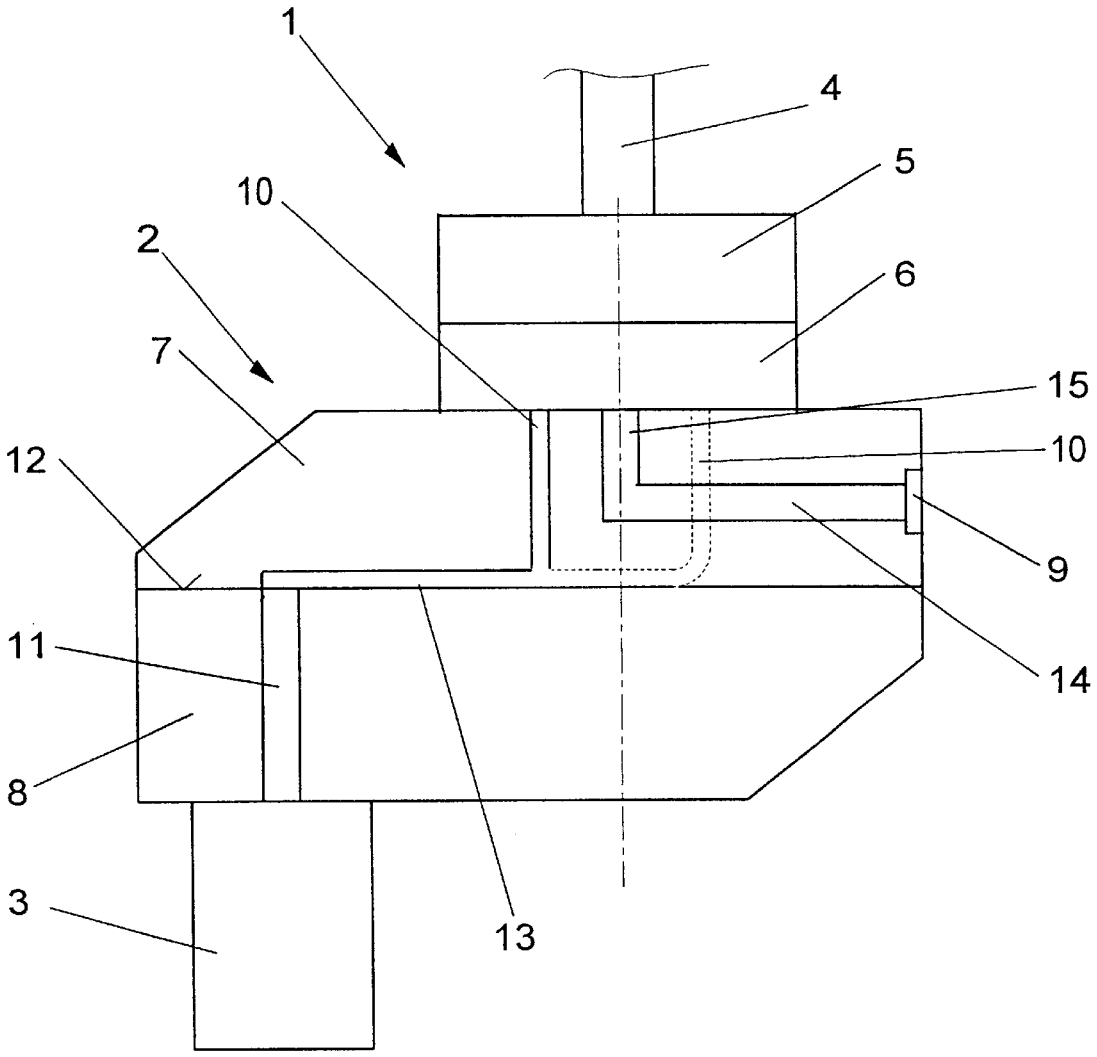
FIG. 5 is a schematic, cross sectional view of a further embodiment of a spin beam.

FIG. 5 illustrates a further embodiment of a divided melt distributor block 2. In this embodiment, the separation extends in a horizontal plane. In the separating line 12, distributor lines 13 are formed between the lower part 8 and the upper part 7. The distributor line 13 is arranged in the upper part 7 by a groove. With respect to the arrangement of spin pump 1 as well as spinnerets 3 reference may be made to the description of FIGS. 1 and 2. Other than in the embodiment of FIG. 2, the melt inlet end 9 is arranged in the upper part 7. The melt inlet end 9 is again connected to the spin pump by means of melt channels 14 and 15. In this embodiment, melt channel 14 is bored into upper part 7 at a right angle to melt channels 10.

Figure 6:
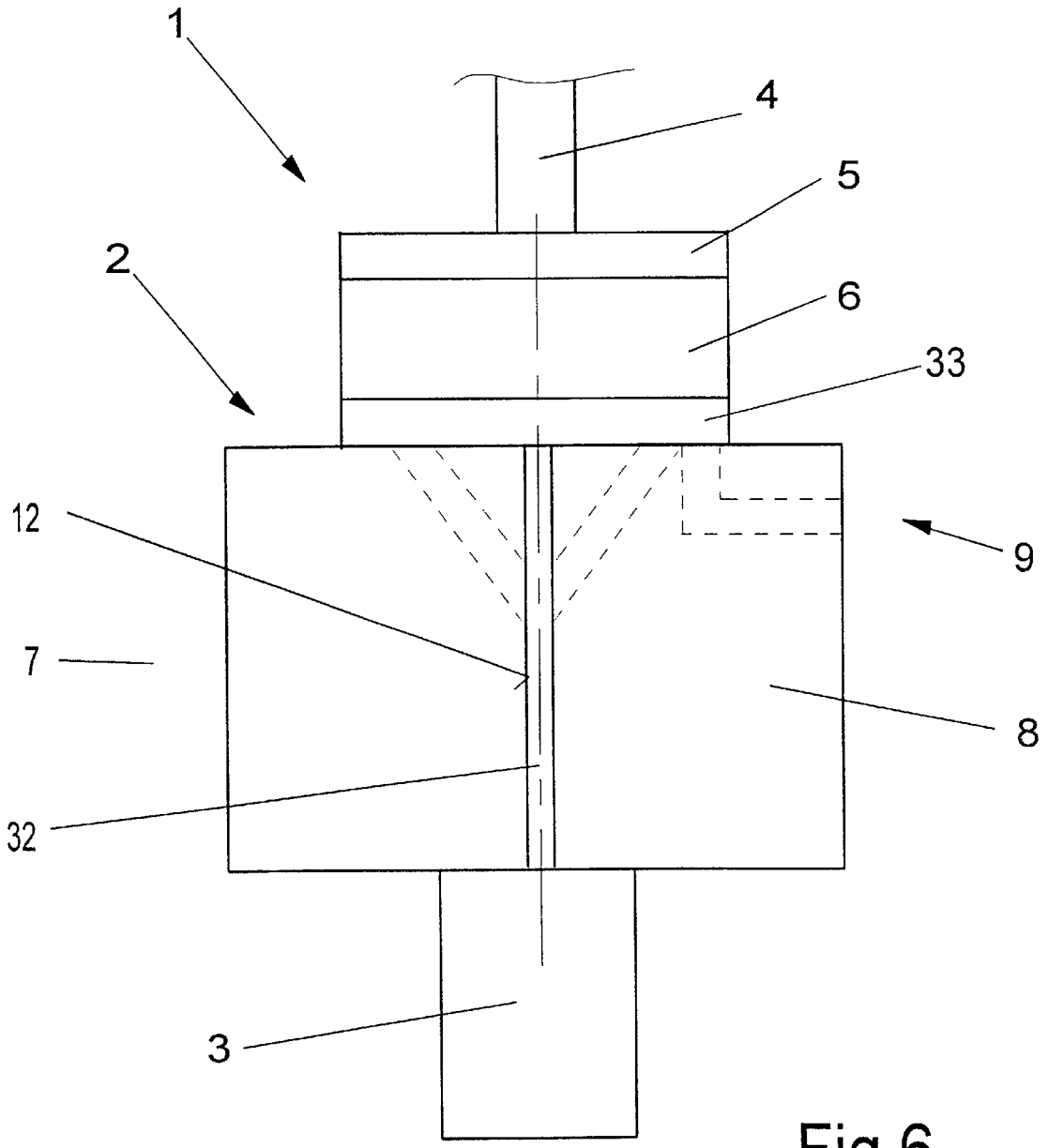
FIG. 6 is a schematic, cross sectional view of a further embodiment.

A further embodiment of the spin beam in accordance with the invention is shown in FIG. 6. In this embodiment, the melt distributor block 2 consists of two structural members 7 and 8. Between structural members 7 and 8, a substantially vertically aligned separating line 12 is formed. In the separating line 12 a plate 32 is inserted between structural parts 7 and 8. Structural part 7, plate 32, and structural part 8 are joined by frictional engagement. The upper side of the melt distributor block mounts on structural members 7 and 8 a spin pump 1. The spin pump 1 consists of an intermediate plate 33, a housing plate 6, and a pump plate 5, as well as a drive shaft 4. The spin pump 1 is flanged with intermediate plate 33 to melt distributor block 2. In the plane of the separating line, the underside of the melt distributor block mounts spinnerets 3. The melt lines are arranged as grooves in plate 32. The connection of the pump outlets to the melt line is realized in part directly by a groove provided in plate 32, or via obliquely extending melt channels, which connect the pump outlets located outside of the separating line with the distributor lines in plate 32. The melt is supplied to the spin pump via melt inlet end 9.

In the embodiment shown in FIG. 6, the distributor lines are formed by grooves in plate 32. These grooves extend through plate 32 and are defined by the surfaces of adjoining structural members 7 and 8. However, it is also possible to form the grooves by flutes in part between structural member 7 and plate 32 and between structural member 8 and plate 32.

The spin pump 1, melt distributor block 2, and spinnerets 3 are accommodated in a heating box (not shown). The heating box may be a hollow body with an inside surface and an outside surface. Between them, the two surfaces form a hermetically sealed hollow space, which is filled with a heating medium, for example, a heating liquid. The inside surface surrounds the parts being heated.

The two previously described embodiments of the invention have all the advantage that the melt line can be made with high precision. Thus, cross sections and lengths of distributor grooves can be made, which lead to homogeneous melt qualities in all spinning positions. In addition, the block construction results in that the temperature differences or temperature fluctuations in the heating system do not affect the melt flow.

What is claimed is:

1. A spin beam for spinning a plurality of synthetic filament yarns comprising a melt distributor block comprising two structural members which are interconnected in a pressure tight manner along a separating line, a spin pump mounted to said distributor block and having a plurality of discharge outlets, a plurality of spinnerets that are linearly aligned and mounted to said distributor block, and a plurality of melt distributor lines each extending between one of the discharge outlets of the spin pump and an associated spinneret, and with each of the distributor lines including a segment which extends along the separating line of the two structural members of the melt distributor block, said separating line extending in a plane which is oblique to the horizontal, so that a gradient is formed in the melt distributor lines between the spin pump and the spinnerets, and wherein the oblique plane defines an upper structural member and a lower structural member, and wherein the spin pump is mounted to the upper structural member and the spinnerets are mounted to the lower structural member.

2. The spin beam as defined in claim 1 wherein said two structural members of said melt distributor block have opposing surfaces along said separating line, and wherein said segment of each of said distributor lines includes a groove in one or both of said opposing surfaces.

3. The spin beam as defined in claim 2 wherein said segment of each of said distributor lines further includes a pipe which is positioned in said groove.

4. The spin beam as defined in claim 2 wherein at least one of the opposing surfaces comprises two surface regions separated by a shoulder, with the grooves being disposed in an outermost one of the surface regions.

5. The spin beam as defined in claim 1 wherein said two structural members of said melt distributor block have opposing surfaces along said separating line, and a plate is positioned between said opposing surfaces and is held therein in a pressure tight manner, and wherein said segment of each of said distributor lines includes a groove formed between the plate and one of the opposing surfaces.

6. The spin beam as defined in claim 1 wherein the oblique plane is inclined by about 30° from the horizontal.

7. The spin beam as defined in claim 1 wherein said spinnerets define a vertical plane, and wherein the spin pump is laterally offset from said vertical plane.

8. The spin beam as defined in claim 1 further comprising a melt supply line for the spin pump and which includes an inlet line segment in the lower structural member and an outlet line segment in the upper structural member which leads to said spin pump.

9. The spin beam as defined in claim 1 wherein said spin pump comprises pump gears, and wherein the upper structural member includes an upper flat surface which is adjacent said pump gears.

10. The spin beam as defined in claim 1 wherein the inside cross-section of each of the melt distributor lines is substantially constant over its length.

11. The spin beam as defined in claim 1 wherein the lengths of the melt distributor lines are substantially uniform.

12. The spin beam as defined in claim 1 wherein each of the melt distributor lines includes an upstream segment which extends from the spin pump to the segment which extends along the separating line and which extends transversely with respect to the segment which extends along the separating line.

13. The spin beam as defined in claim 12 wherein each of the melt distributor lines further includes a downstream segment which extends from the segment which extends along the separating line to the associated spinneret and which extends transversely with respect to the segment which extends along the separating line.

14. The spin beam as defined in claim 13 wherein each of said upstream segments and each of said downstream segments extends substantially vertically.

* * * * *